US006463249B2

(12) United States Patent
Mikita

(10) Patent No.: US 6,463,249 B2
(45) Date of Patent: Oct. 8, 2002

(54) OFFSET PREVENTING LIQUID SUPPLYING DEVICE FOR A TONER IMAGE FIXING DEVICE, AND IMAGE FORMING DEVICE PROVIDED WITH THE SAME OFFSET PREVENTING LIQUID SUPPLYING DEVICE

(75) Inventor: Toshiya Mikita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/760,200

(22) Filed: Jan. 12, 2001

(65) Prior Publication Data

US 2001/0022908 A1 Sep. 20, 2001

(30) Foreign Application Priority Data

Mar. 17, 2000 (JP) ..... 2000-076412

(51) Int. Cl.[7] ..... G03G 15/20
(52) U.S. Cl. ..... 399/324
(58) Field of Search ..... 399/320, 324, 399/325, 328; 118/DIG. 1

(56) References Cited

U.S. PATENT DOCUMENTS 5,991,562 A * 11/1999 Ito et al. ..... 399/325 X

FOREIGN PATENT DOCUMENTS

| | | | |
|---|---|---|---|
| JP | 8-137317 | | 5/1996 |
| JP | 11-095593 | * | 4/1999 |
| JP | 11-095596 | * | 4/1999 |
| JP | 11-109778 | * | 4/1999 |
| JP | 11-344891 | * | 12/1999 |

* cited by examiner

*Primary Examiner*—Sandra Brase
(74) *Attorney, Agent, or Firm*—Kenner, Otto, Boisselle & Sklar

(57) ABSTRACT

An offset preventing liquid supplying device is provided for supplying offset preventing liquid to a heat roller of a toner image fixing device for fixing a toner image developed on a recording material by heating with the heat roller. The offset preventing liquid supplying device includes a storage tank for storing offset preventing liquid, a liquid applying mechanism for applying offset preventing liquid onto a cylindrical surface of the heat roller and a pump for supplying the offset preventing liquid to the liquid applying mechanism. The liquid applying mechanism has a series of offset preventing liquid supplying ports provided from an upstream side to a downstream side thereof in an offset preventing liquid supplying direction and an upstream side liquid supplying port is open at an upper position and a downstream side liquid supplying port is open at a lower portion.

4 Claims, 10 Drawing Sheets

OFFSET PREVENTING LIQUID SUPPLYING DEVICE FOR A TONER IMAGE FIXING DEVICE, AND IMAGE FORMING DEVICE PROVIDED WITH THE SAME OFFSET PREVENTING LIQUID SUPPLYING DEVICE

BACKGROUND OF THE INVENTION

The present invention relates to an offset preventing liquid supplying device for a toner image fixing device for use in an electro-photographic type image forming device such as a copying machine and the like and also relates to an image forming device provided with the same offset preventing liquid supplying device.

Generally, a toner image fixing device for use in the electro-photographic type image forming device is provided with a pair of fixing rollers both of which abut at their cylindrical surfaces to each other and at least one of which is of the heat-roller type incorporating a heater in its cylindrical body. The heat-roller type toner image fixing device is generally such that a toner image developed on a recording material in an image forming step is fixed thereon by heat while the material passes, being heated, through a nip between the paired fixing rollers. Direct contact of the fixing roller with a toner image developed on a recording material may cause toner particles to adhere to the working surface of the fixing roller, which particles is then undesirably transferred onto a toner image to be fixed on a next recording material.

As such, so-called "offset toner" is apt to occur in the fixing device of the color type image forming device rather than in the fixing device of the monochromatic type image forming device. This is because the fixing device of the color type image forming device must use fixing rollers with a thick rubber coat having a large heat capacity and covering ability to fuse mixed-color toners of a thick and uneven toner-developed image consisting of plural toner layers (e.g., Magenta, cyan, yellow and black layers) by heating. Such fixing rollers may not possess sufficient release ability due to its thick rubber layer.

In the conventional fixing devices of the color-type image forming device, as shown for example in FIG. 1, offset preventing liquid (g) stored in a storage tank (a) being able to supply is sucked by a piezoelectric or electromagnetic type pump (b) disposed above the tank (a) through a tubular piping (c) and applied by an applying means (e) to a working surface of a heat roller (fixing roller) (d). The applying means (e) is provided with a supplying pipe (f) that extends above and along the heat roller body (d) and has plural supplying ports (h) arranged in the same direction thereof to feed droplets of offset preventing liquid (g) onto a felt material (i) and a surface of an applying roller (t). Rotating in contact with the heat roller (d), the applying roller (t) applies a uniform coat of the offset preventing liquid (g) over a whole length of the cylindrical surface of the heat roller (d). An excess of the offset preventing liquid (g) falling from the applying roller is collected in a pan (j) disposed under the heat roller (d), wherefrom it is returned through a tubular return piping (k) to the storage tank (a).

The offset preventing liquid (g) is thus circulated from the storage tank (a) to the applying means (e). When a level of the offset preventing liquid (g) in the storage tank (a) lowered below a specified level, a sensor (s) for controlling the amount of the liquid in the tank (a) actuates to warn the user of the need for supplying the liquid (g) in the tank (a) and/or to temporally stop the toner image forming process.

In the offset preventing liquid supplying device, it is very important to maintain a constant feed rate of the offset preventing liquid to a full length of the working surface of the heat roller (d). A partial break of a coat of offset preventing liquid (g) applied on the working surface of the heat roller in its longitudinal direction may result in wrapping of the recording sheet around the heat roller (d) and/or unintentional transferring of offset toner to an image fixed on a next recording sheet. Partially excessive supplying of the offset preventing liquid to the heat roller (d) in its longitudinal direction may cause leakage of the liquid from the fixing device.

Therefore, the offset preventing liquid supplying device has the pipe (f) with upwardly opening ports (h) made in its wall relative to the applying means (e) as shown in FIGS. 2 and 3 to simultaneously supply the offset preventing liquid (g) through all the supplying ports (h) on the condition that the image forming device is horizontally mounted.

The equally balanced feed of the offset preventing liquid (g) relative to the longitudinal direction of the heat roller (d) is realized by differentiating diameters of the supplying ports on the upstream (front side in FIGS. 4 and 5) and downstream (rear side in FIGS. 4 and 5) sides of the offset preventing liquid supplying pipe (f) as shown in FIGS. 4 and 5. In practice, the offset preventing liquid supplying ports (h) disposed closer to the upstream (front) end of the offset preventing liquid supplying pipe (f) are smaller in diameter and the ports disposed closer to the downstream (rear) end of the supplying pipe (f) are larger in diameter.

Recently, there has been a steady trend of space-saving design (miniaturization) of the image forming devices. As the result, the image-forming devices may be used as mounted at various places including not-horizontal places. Accordingly, it is necessary to consider a margin for tilting angle of the device.

In this instance, the conventional offset preventing liquid supplying device uses a liquid supplying pipe (f) having a series of upwardly opening ports (h) made in its upper wall of the applying means (e). When the image forming device is mounted in a tilted state with the supplying pipe (f) tilted up in the downstream (rear side) direction relative to the length of the heat roller (d), the upstream side (front side) of the supplying pipe (f) is located at a lower level as shown in FIG. 6, resulting in supplying offset preventing liquid (g) merely from the upstream side ports (h). Namely, in this case, the liquid (g) hardly flows out through the downstream side ports (h), causing unbalanced (uneven) supplying of the offset preventing liquid (g) relative to the length of the heat roller (d). In FIG. 6, letter "n" designates a horizontal line.

When the image forming device is mounted in a position tilted in the transverse direction perpendicular to the longitudinal direction of the heat roller (d) as shown in FIGS. 7 and 8, the upwardly opening ports (h) in the wall of the supplying pipe (f) may correspondingly reduce their cross-sectional areas, causing reduction of outflows (feeds) though every port (h). Furthermore, no feed of the offset preventing liquid (g) from the downstream side ports (h) may occur because the feed of the liquid (g) through the upstream side ports under a higher pressure is accompanied by forming an air layer (v) due to the viscosity of the offset preventing liquid (g) in the downstream portion of the supplying pipe (f) with a low pressure.

SUMMARY OF THE INVENTION

An object of the present invention is to provide an offset preventing liquid supplying device of a toner image fixing device for use in an image forming device, which system is capable of uniformly supplying offset preventing liquid to a working surface of a heat roller with an evenly balanced feed over a full length of the roller irrespective of the tilted state of the image forming device, and an image forming device provided with the same offset preventing liquid supplying device.

The present invention relates to an offset preventing liquid supplying device for supplying offset preventing liquid to a working surface of a fixing roller of an toner image fixing device for thermally fixing a toner image developed on a recording material. This system includes a storage means for storing the offset preventing liquid, a liquid applying means for applying the offset preventing liquid to the working surface of the heat roller and a pump for supplying the offset preventing liquid from the storage means to the liquid applying means. The liquid applying means has a supplying pipe with series of supplying ports made in a wall thereof in the direction of a liquid flow therein from the upstream side to the downstream side. The supplying ports are arranged in such a way that the ports nearer to the upstream end are open at higher levels and the ports nearer to the downstream end are open at lower levels in the wall of the supplying pipe.

The above-mentioned features of the supplying pipe realizes smooth supplying of the offset preventing liquid through the supplying ports being open at lower levels in the wall of the downstream portion of the supplying pipe even if the image forming device such as a copier is placed in a tilted state with the offset preventing liquid supplying pipe sloped up in the downstream direction along the length of a heat roller to be coated with the offset preventing liquid.

In case when the image forming device is used in a state tilting in a direction perpendicular to a longitudinal direction of the heat roller, there is no reduction in cross-section of supplying ports being open at lower positions in the wall of the downstream portion of the supplying pipe. This makes it possible to smoothly feed the offset preventing liquid through the downstream side ports at the lower positions in the wall of the supplying pipe even if an air layer is formed in the downstream portion of the supplying pipe due to the viscosity of the liquid therein while the liquid under a relatively high pressure flows out through the upstream side ports.

This makes it possible to maintain equally balanced feeds of offset preventing liquid from the upstream side ports and downstream side ports along the length of the heat roller.

The locations of the offset preventing liquid supplying ports in the wall of the supplying pipe are more specifically determined as follows:

Namely, each of offset preventing liquid supplying ports are provided in the wall of the supplying pipe in such a way that opening positions of the ports are shifted lower in the direction from the upstream side to the downstream side of the supplying pipe. In this instance, the offset preventing liquid can smoothly flow out through the supplying ports which openings are lowered in the direction toward the downstream end irrespective of the tilted state of the image forming device in which the supplying pipe has a slope with the downstream side up or a slope in a plane perpendicular to the longitudinal direction of the heat roller. Owing to the above, it is possible to maintain evenly balanced feeds of the offset preventing liquid through the supplying ports in both upstream and downstream portions of the supplying pipe.

Each of offset preventing liquid supplying ports are also provided in pairs in the wall of the supplying pipe in such a way that two ports of each pair are located at opposite positions in a section perpendicular to the direction of the liquid flow in the supplying pipe. This not only realizes smooth supplying of the offset preventing liquid through the supplying ports in both upstream and downstream portions but also provides a great advantage in achieving evenly balanced supplying of the offset preventing liquid to a working surface of the heat roller along the full length thereof by supplying through a lower positioned port of each pair when the supplying pipe has a slope in the direction perpendicular to the longitudinal direction of the heat roller.

Specifically, an image forming device provided with the above described offset preventing liquid supplying device of a toner image fixing device can reliably preventing a paper sheet from wrapping around a heat roller due to partially insufficient feed of offset preventing liquid in the longitudinal direction of the heat roller and can surely prevent contamination with offset toner of an image to be fixed on a next paper sheet. It is also capable of reliably preventing leakage of offset preventing liquid fed in excess to a part of the heat roller. All the above features enable the image forming device to achieve an increased reliability of its performance.

PREFERRED EMBODIMENTS OF THE INVENTION

Referring to the accompanying drawings, preferred embodiments of the present invention will be described below.

An offset preventing liquid (silicone oil) supplying system of a toner image fixing device according to the present invention is described as incorporated in an electrophotographic type digital color copier (image forming device).

Figure 1:
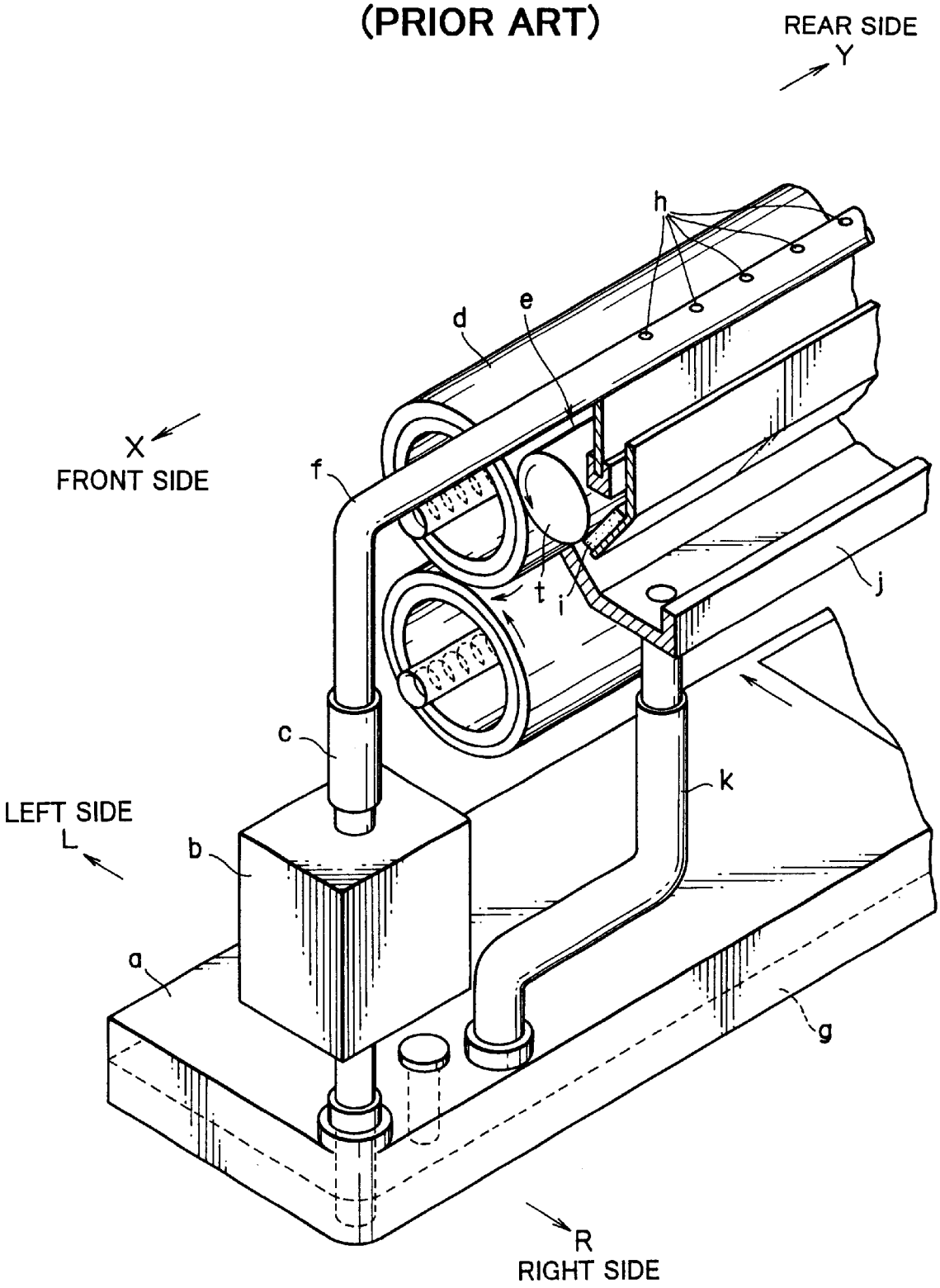
FIG. 1 (PRIOR ART)
FIG. 1 is a perspective view of an exemplary conventional offset preventing liquid supplying device.
Figure 2:
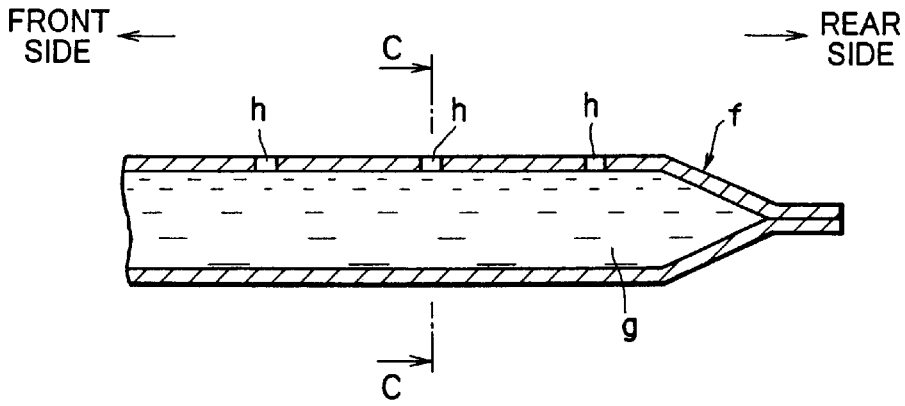
FIG. 2 (PRIOR ART)
FIG. 2 is a sectional view of the downstream side of a horizontally placed supplying pipe when being viewed from the right side of the conventional offset preventing liquid supplying device of FIG. 1.
Figure 3:
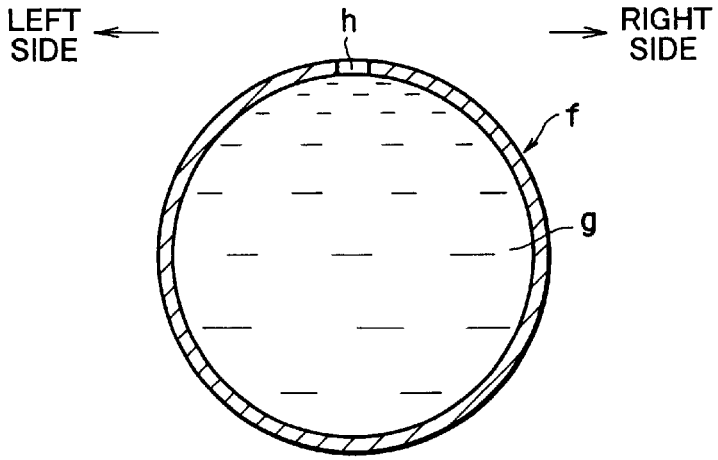
FIG. 3 (PRIOR ART)
FIG. 3 is a sectional view taken along the plane C—C of FIG. 2.
Figure 4:
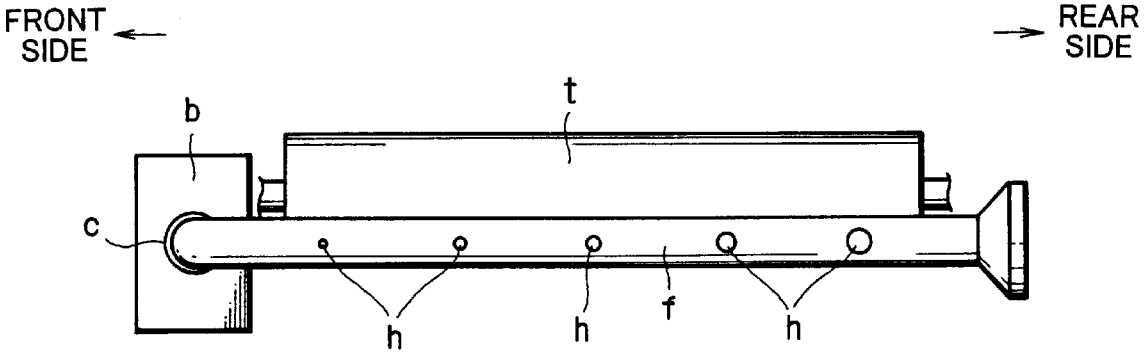
FIG. 4 (PRIOR ART)
FIG. 4 is a plan view of a supplying pipe when being viewed from the top of another conventional offset preventing liquid supplying device.
Figure 5:
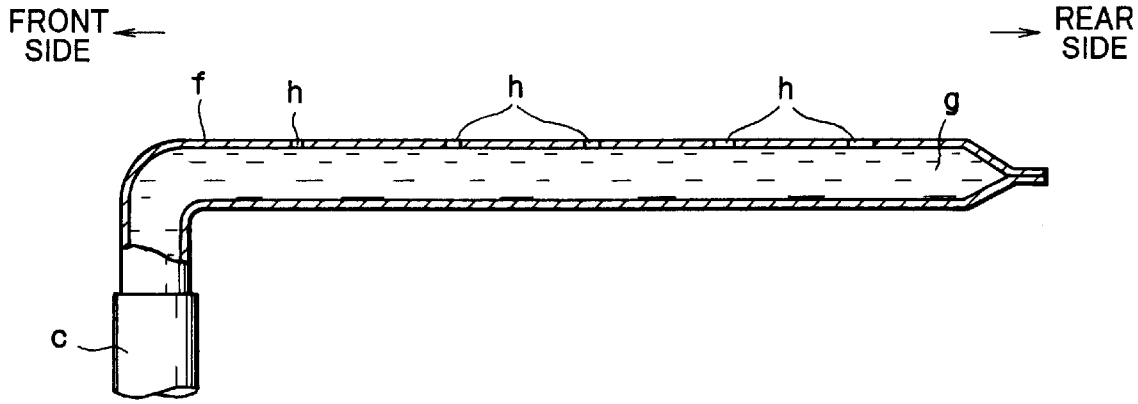
FIG. 5 (PRIOR ART)
FIG. 5 is a sectional view of a supplying pipe when being viewed from the right side of the conventional offset preventing liquid supplying device of FIG. 4.
Figure 6:
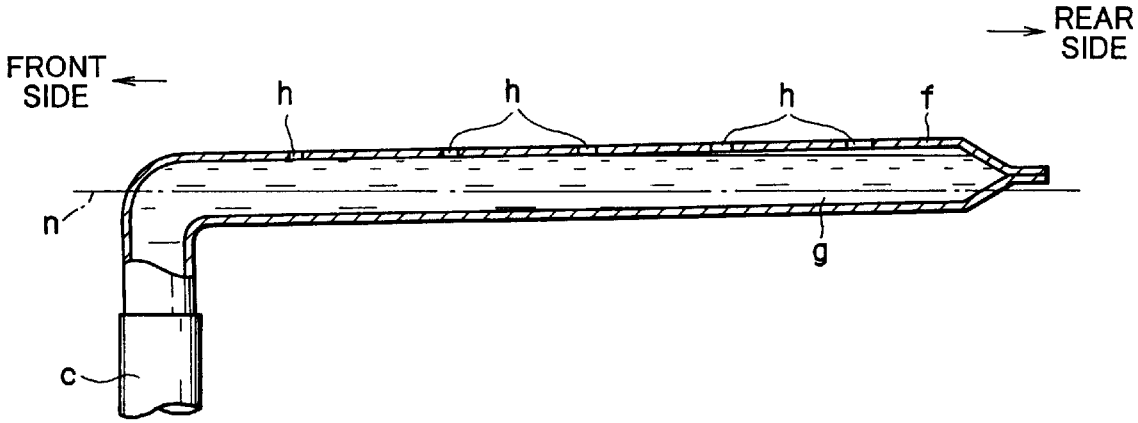
FIG. 6 (PRIOR ART)
FIG. 6 is a sectional view of the supplying pipe tilted up in the downstream direction when being viewed from the right side of the conventional offset preventing liquid supplying device of FIG. 4.
Figure 7:
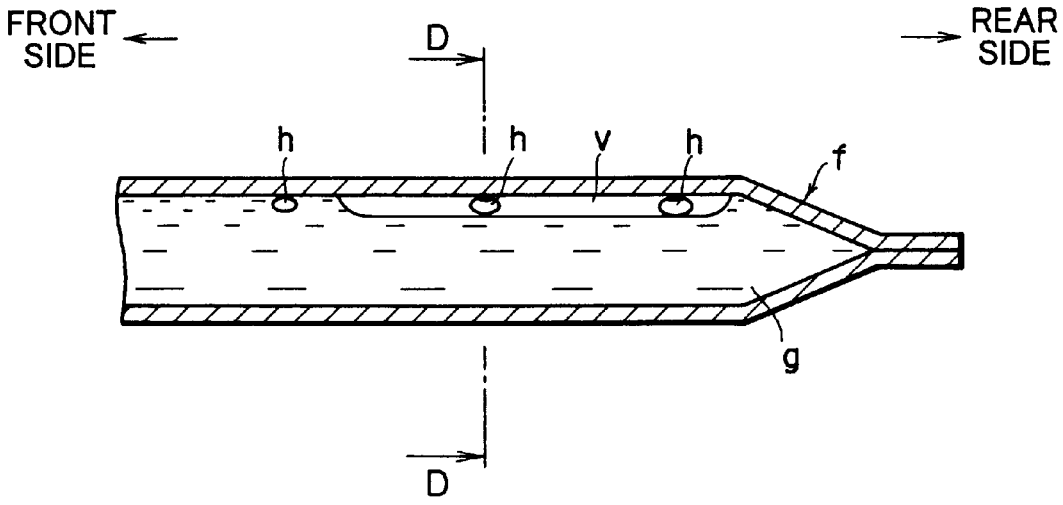
FIG. 7 (PRIOR ART)
FIG. 7 is a sectional view the downstream side of the supplying pipe tilted up in the leftward direction when being viewed from the right side of the conventional offset preventing liquid supplying device of FIG. 4.
Figure 8:
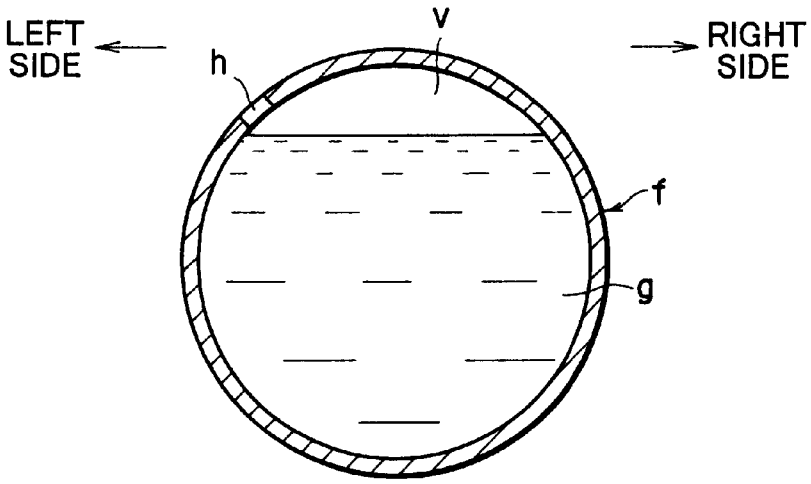
FIG. 8 (PRIOR ART)
FIG. 8 is a sectional view taken along the plane D—D of FIG. 7.
Figure 9:
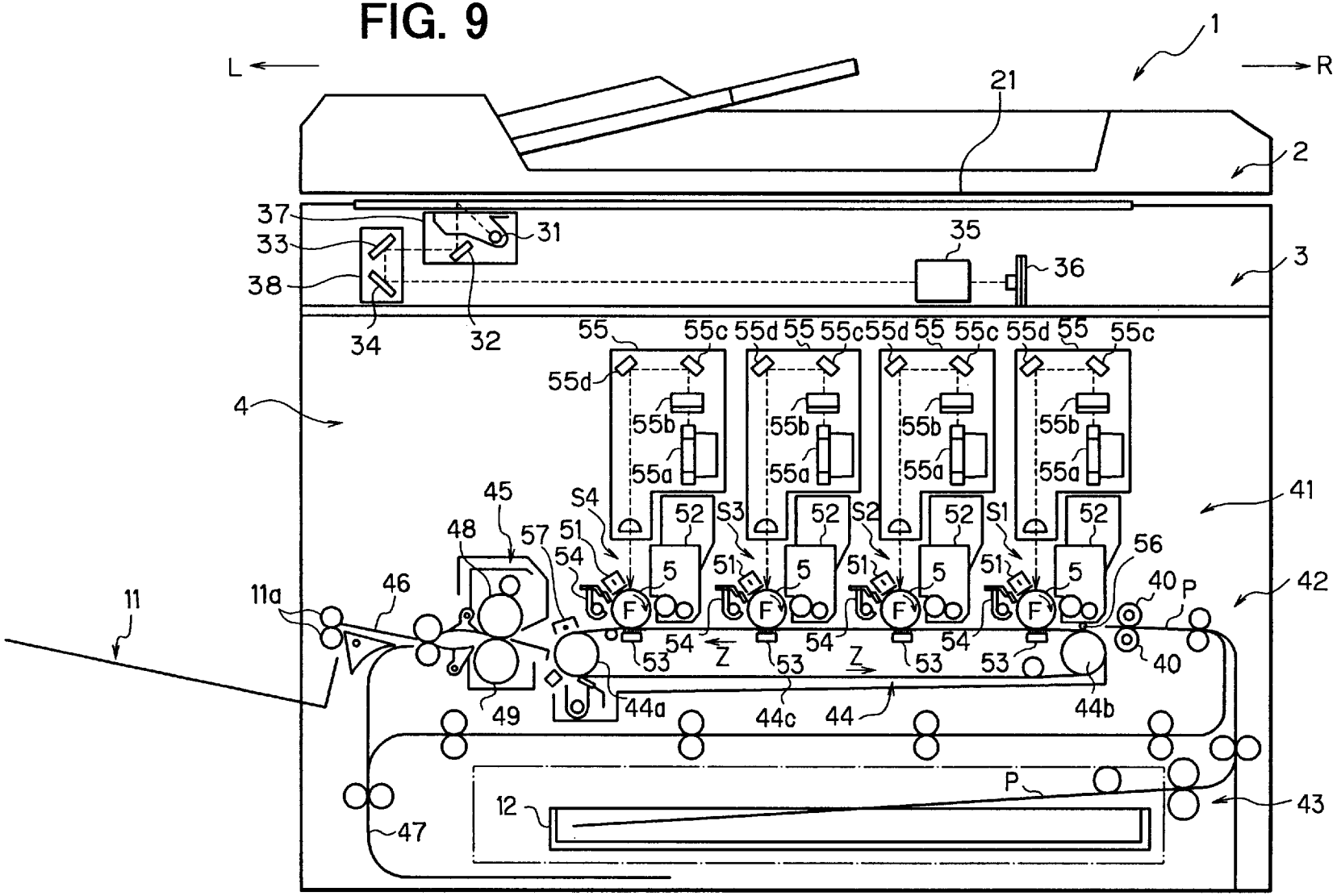
FIG. 9 is a front sectional view of a digital color copier provided with a toner image fixing device according to the present invention.

A whole system of the digital color copier:

FIG. 9 is a schematic front sectional view of a digital color copier 1. As shown in FIG. 9, the digital color copier 1 is provided with a recirculating automatic document feeder (RADF) portion 2, an image reading portion 3 and an image forming portion 4, each of which will be described below in detail.

[Recirculating automatic document feeder (RADF) portion 2]

The recirculating automatic document feeder 2 is disposed on the top of a document table 21 made of a transparent glass. It can be open and closed with respect to the document table 21 and is mounted in a given position relative to the document table. This document feeder (RADF) 2 is designed to feed an original document sheet to the document table 21 in such a manner that one side (e.g., the top surface) of the original is placed on a given position of the document table 21 opposite to the image reading portion 3. On completion of reading that side of the original by the image reading portion 3, the document feeder 2 turns over the original and feeds it again to the given position of the document table 21 to place the other side (e.g., the rear surface) of the original document opposite to the image reading portion 3. When images on both surfaces of the original were read, the document feeder 2 delivers the original out of the main body and, then, begins supplying of a next original to the document table 21. The above document supplying and reversing operations are controlled in accord with an entire system operation of the digital color copier 1.

[Image Reading Portion 3]

The image reading portion 3 is intended to read an image from an original put on the document table 21 to form image data of originals transported one by one to the document table 21 by the document feeder 2. This image reading portion 3 is disposed below the document table 21 in the upper part of the digital color copier 1. The image reading portion 3 includes a illuminating light source 31, first, second and third reflecting mirrors 32, 33 and 34, an image forming optical lens 35 and a photoelectric converting element 36. In this case, the illuminating light source 31 and the first reflecting mirror 32 compose a first scanning unit 37, while the second and third reflecting mirror 33 and 34 compose a second scanning unit 38.

The light source 31 illuminates an image of an original transported in the RADF portion 2 and put on the document table 21 thereof. The mirrors 32, 33 and 34 are arranged so that light reflected image from the original image is reflected first in a given direction (leftward in FIG. 9) and then downward and finally directed to the optical lens 35 along light path shown by broken lines.

The first scanning unit 37 (composed of the light source 31 and the reflecting mirror 32) can reciprocally travel at a specified speed in a horizontal direction (from left to right and reverse in FIG. 9) along the bottom surface of the document table, keeping a constant distance from the bottom surface thereof. The second scanning unit 38 (composed of the second and third reflecting mirrors reciprocally travels parallel with the first scanning unit 37 keeping a constant speed relative to the speed of the first scanning unit 37.

The image forming optical lens 35 reduces the size of the original image light reflected from the third mirror 34 of the second scanning unit 38 and focuses the light of the contracted image at a given position on the photoelectric converting element 36.

The photoelectric converting element 36 photo electrically converts focused light of the image into a series of output electrical signals. The photoelectric element 36 is a three line color charge coupled device (CCD) which can read a monochromatic image or a color image, decompose it to color components R(Red), G(Green) and B(Blue) and output the data of three lines. The series of electrical signals representing the original image information is further transferred from the photoelectric converting element 36 to an image processing unit (not shown) for further necessary processing.

[Image Forming Portion 4]

The image forming portion 4 is provided with an image forming system 41 and a sheet transfer system 42.

The image forming system 41 is disposed in the upper portion of the body 10 in the digital color copier 1 and is provided in its lower portion with a paper supplying mechanism 43 that feeds separately a sheet of copy paper (recording material) P from a pile of paper sheets on a paper tray 12 to the image forming system 41. A separate paper sheet P (cut sheet) is transported to the image forming system 41 under timing control by a pair of (upper and lower) register rollers 40, 40 disposed close to an inlet of the image forming system 41 (on the right hand in FIG. 9). The paper sheet P having an image formed on one side is transported again to the image forming system 41 in accord with the timing control of the image output unit.

In the middle portion of the body 10 in the digital color copier 1, a transfer belt device 44 is disposed under the image forming system 41. The transfer belt device 44 comprises a transfer endless belt 44*c* engagingly stretched between a driving roller 44*a* on L side (left in FIG. 9) and a driven roller 44*b* on R side (right in FIG. 9), which belt is driven in the direction shown by an arrow Z in FIG. 9. The paper sheet P is fed by the register rollers 40—40 onto the transfer belt 44*c* by which it is further transported from the upstream side (the right side) to the downstream side (the left side), being stably held thereon by the action of electro static force.

A toner image fixing device 45 for fixing a toner image formed on the paper sheet P is arranged on the downstream side (left in FIG. 9) of the transfer belt device 44. The toner image transferred and formed on the paper sheet P is fixed thereon by heating while passing a nip between the fixing rollers 48, 49 (described later) of the fixing device 45. The fixing device 45 is further provided at its downstream end with switching gate 46 that selectively switches a path from the fixing device 45 to: a path for delivering the paper sheet P by a pair of outlet rollers 11*a*, 11*b* to an outlet tray 11 attached to the external wall of the copier housing 10 or a path for returning it through the lower portion of the transfer belt device 44 to the image forming system 41. The path for returning the paper sheet P is provided with a switchback transporting device 47. The paper sheet P fed by the switching gate 46 to the returning path is reverse directed with its rear edge forward by the switchback transporting device 47 toward the image forming system 41. In the image forming portion 41, image forming stations No.1(S1), No.2(S2), No.3(S3) and No.4(S4) are arranged in parallel to each other and closely above the transfer belt 44*c* in the described order from the upstream side (right in FIG. 9) of the sheet transferring path. In this instance, the paper sheet P on the transfer belt 44*c* is transported to the image forming stations S1–S4 subsequently.

The image forming stations S1–S4 have the substantially same structure including a light sensitive drum 5 that can rotate in the direction shown by arrows F in FIG. 9. Each light sensitive drum 5 is surrounded by a charger 51 for evenly charging a working surface of the light sensitive drum 5, a developing device 52 for developing with toner a latent image formed on the surface of the light sensitive drum 5, a transfer discharger 53 for transferring the developed toner image (visible image) onto a paper sheet P and a cleaning device 54 for scrapping off toner remaining on the drum surface.

The above devices are arranged around the light sensitive drum 5 in the described order in the rotational direction (shown by arrows F) of the drum.

Above each light sensitive drum 5 is a laser beam scanner unit (referred hereinafter to as LSU) 55, which is composed of a semiconductor laser element (not shown) for generating dot light modulated according to image data, a polygonal mirror (deflecting device) 55*a* for deflecting a laser beam from the semiconductor laser element in the main horizontal scanning direction, a lens fθ 55*b* and mirrors 55*c*, 55*d* for forming an image on a surface of the light sensitive drum 5.

The LSU 55 of the first image forming station S1 receives an image signal corresponding to a black color image component of an original color image, the LSU 55 of the second image forming station S2 receives an image signal corresponding to a cyan color image component, the LSU 55 of the third image forming station S3 receives an image signal corresponding to a magenta color image component and the LSU 55 of the fourth image forming station S4 receives a yellow color image component. As the result, latent images corresponding to color converted image information of an original image are formed on the external cylindrical surfaces of respective light sensitive drums 5.

The developing device 52 of the first image forming station S1 stores black toner, the developing device 52 of the second image forming station S2 stores cyan color toner, the developing device 52 of the third image forming station S3 stores magenta color toner and the developing device 52 of the fourth image forming station S4 stores yellow toner. The latent images formed on the respective light sensitive drums 5 are developed with toner from the respective developing devices 52 (the respective color). The original image information is converted by the image forming system 41 into color component images that are thus reproduced as respective color component images by the respective developing devices.

The charger 56 is disposed between the first image forming station S1 and the paper supplying device 43 and electrically charges the surface of the transfer belt 44*c*. The paper sheet P fed by the paper supplying device 43 and persistently adheres to the transfer belt 44*c* by the effect of electrostatic force and reliably transported by the transfer belt 44*c* through the first to fourth image forming stations S1–S4.

A discharger 57 is disposed just above the driving roller 44*a* of the transfer belt 44*c* between the fourth image forming station S4 and a fixing device 45. The discharger 57 is supplied with an alternate current to separate the paper sheet P from the transfer belt 44*c*.

In the above described digital color copier, a paper sheet P is fed from a paper sheet cassette 12 into a guide of a paper transporting path of the paper supplying device 43 and its front edge is detected by a (not shown) sensor that in turn generates a detection signal to paired register rollers 40, 40 for temporally stopping the paper sheet P. The paper sheet P is then sent onto the transfer belt 44*c* rotating in the direction shown by arrow Z in FIG. 9 in synchronism with the operation of the image forming stations S1–S4. Since the transfer belt 44*c* is electrically charged by the charger 56, the paper sheet P is stably transported by the transfer belt while passing through the image forming stations S1–S4.

At the image forming stations (S1–S4), the respective color toner images are subsequently transferred onto the paper sheet P adhering to the transfer belt 44*c*. On completion of transferring the last toner image at the fourth image forming station S4, the paper sheet P is separated from the transfer belt 44*c* by the action of the discharger 57 and led to the toner image fixing device 45. The paper sheet P with the color image fixed by heat thereon is delivered through a paper outlet (not shown) onto an outlet tray 11 by outlet roller 11*a*.

Figure 10:
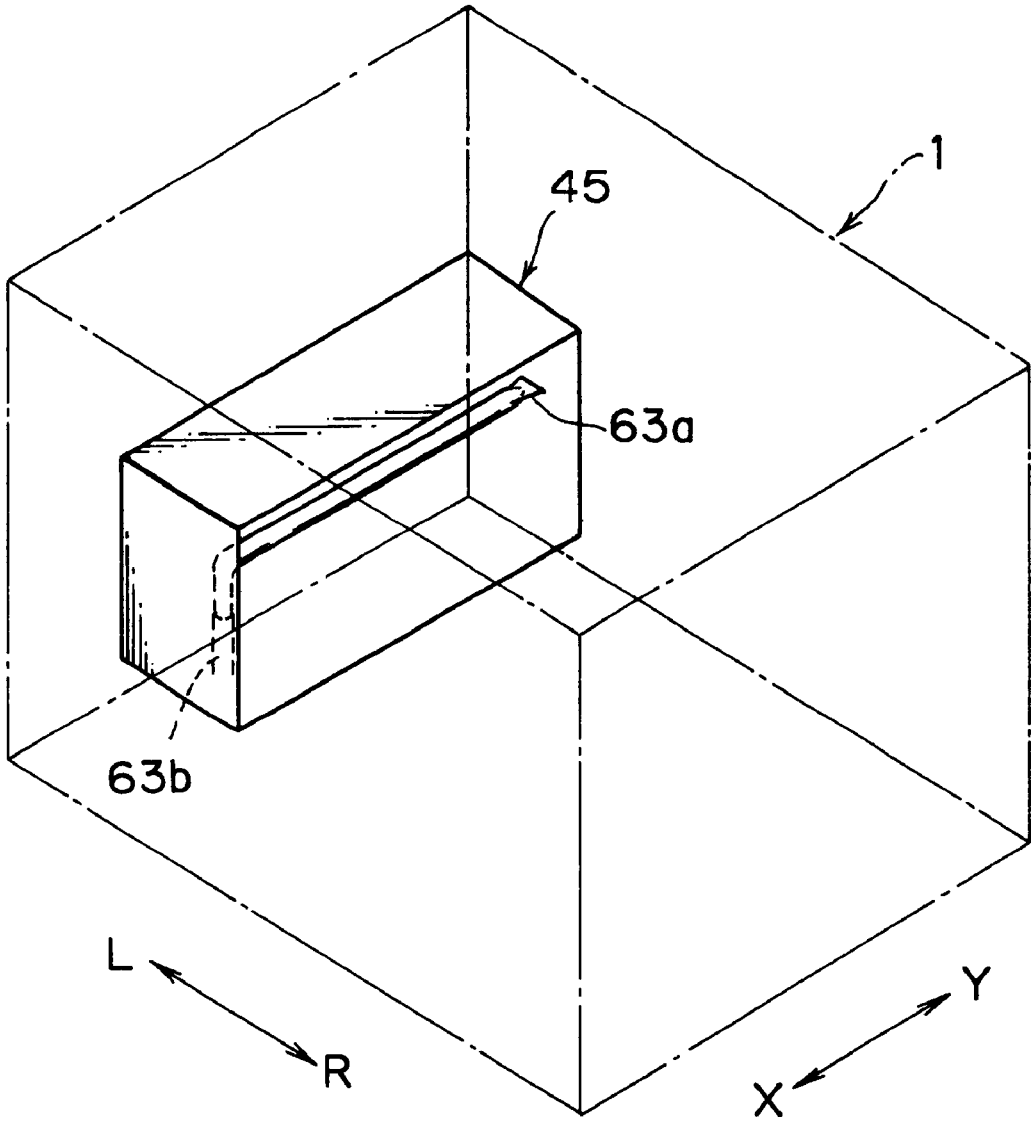
FIG. 10 is a perspective view showing setting position of the image fixing device relative to the digital color copier.

Referring now to FIG. 10, the front-and-rear and light-and-left directions of the digital color copier 1 are defined as follows:

In FIG. 10, the directions toward the front and the rear of the copier 1 are defined as directions X and Y respectively, while the directions toward the left and the right of the copier 1 are defined as the directions L and R respectively. The above definitions are also applied to Figures other than FIG. 10.

Figure 11:
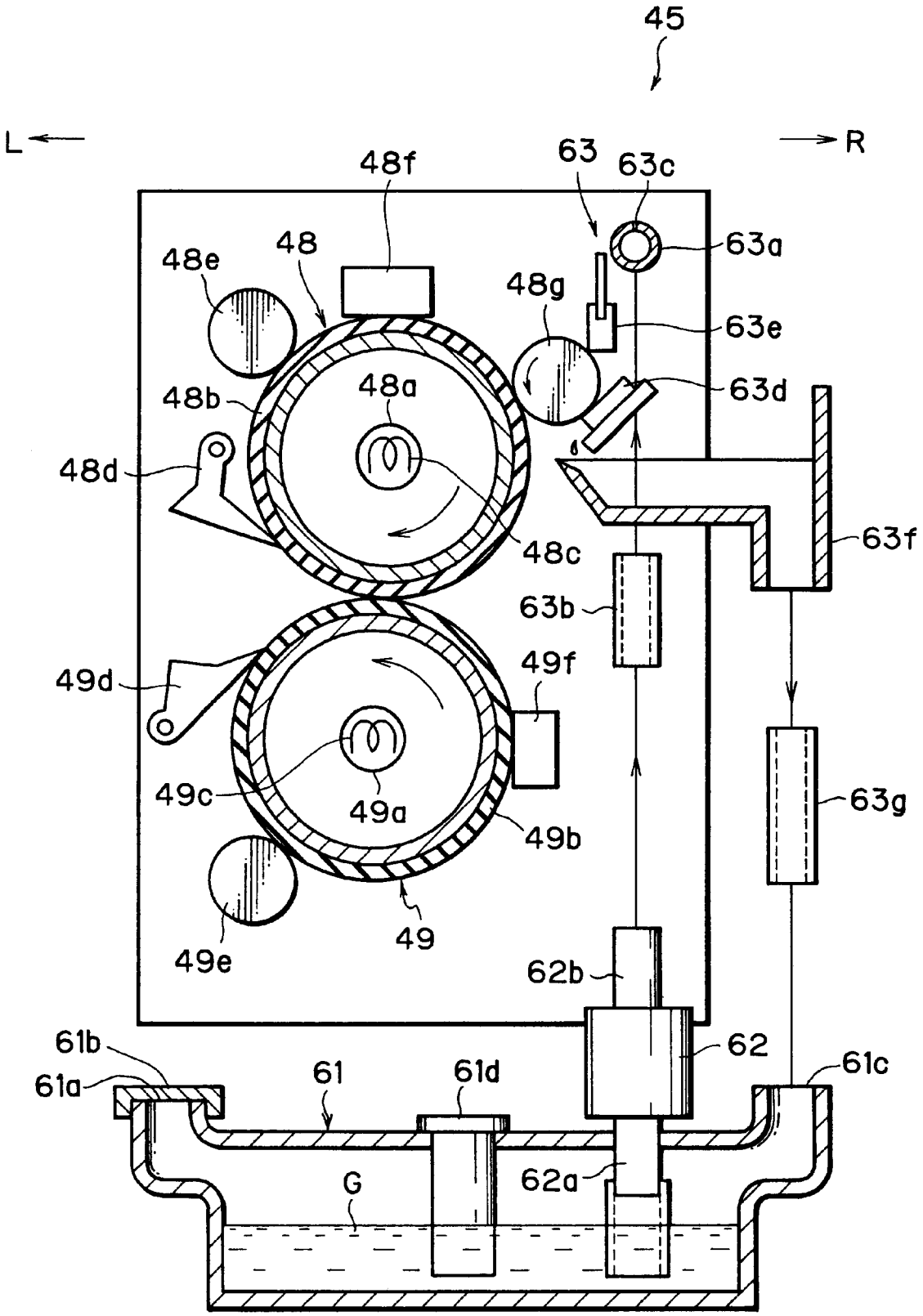
FIG. 11 is a front sectional view of a toner image fixing device.

The toner image fixing device 45 is provided with an upper fixing roller (heat roller) 48 and a lower fixing roller 49, which are disposed with their working surfaces pressed against each other as shown in FIG. 11. Each of the upper and lower fixing rollers 48 and 49 is composed of an aluminum made core cylinder 48*a*(49*a*) covered with a silicone rubber layer 48*b*(49*b*), in which a heater 48*c*(49*c*) composed of a halogen lamp is incorporated.

The upper fixing roller 48 is surrounded by an upper sheet separating portion 48*d*, an upper cleaning roller 48*e*, an upper roller temperature sensor 48*f* for measuring a surface temperature of the fixing roller and an oil applying roller (rotary member) 48*g*. The lower fixing roller 49 is surrounded by a lower sheet separating portion 49*d*, a lower cleaning roller 49*e* and a lower roller temperature sensor 48*f* for measuring a surface temperature of the lower fixing roller.

The upper and lower sheet separating portion 48*d* and 49*d* are used for separating a paper sheet P from the fixing rollers 48 and 49 respectively. The upper and lower cleaning rollers 48*e* and 49*e* are felt-covered rollers being in contact with respective fixing rollers 48 and 49 to recover offset toner from the roller surfaces. The oil applying roller 48*g* is covered with a rubber layer for applying silicone oil G to the surface of the upper fixing roller 48 contacting thereto. The oil applying roller 48*g* is included in part of the composition of a silicone oil supplying device 60 as an offset preventing liquid supplying device for supplying silicone oil G to the surface of the upper fixing roller 48. The upper and lower roller temperature sensors 48*f* and 49*f* are composed each of a thermistor type sensor capable of contacting with a relevant fixing roller surface and measuring a temperature thereof. The surface temperatures of the fixing rollers 48 and 49, measured by the temperature sensors 48*f* and 49*f*, are output to a fixing operation control portion (not shown). The control portion controls the operation of a power supply to maintain the surface temperatures of the fixing rollers 48 and 49 at a constant specified value by turning ON and OFF the roller heaters 48*c* and 49*c* according to the temperature detection signals from the temperature sensors 48*f* and 49*f*.

The above silicone oil supplying device 60 is provided with an oil tank 61 disposed in the lower portion of the fixing device 45, a piezoelectric or electromagnetic type pump 62 for pumping silicone oil G from the oil tank 61 and a liquid applying device 63 by which the silicone oil G fed by the pump 62 is applied by an applying roller 48*g* to a working surface of an upper heat roller 48. In this instance, silicone oil G having the viscosity of 100 CS to 300 CS may be used in view of a load to the pump 62.

The oil tank 61 is provided at its left (L) end with an oil inlet 61*a* with a plug 61*b* removable for replenishing silicone oil G in the tank. The oil tank is provided at its right (R) end with a return port 61*c* for returning an excess of silicone oil G sucked by the pump 62. A sensor 61*d* is provided to control a necessary amount of silicone oil G in the oil tank 61. When a level of the silicone oil G in the oil tank 61 lowered below a specified level, a sensor 61*d* actuates to warn the user of the need for supplying the silicone oil G in the tank 61 by means of indication on a control panel of the copier 1 and/or to make it temporally impossible to operate the copier 1. The normal operation of the copier 1 can be of course restored by making up the level of the silicone oil G in the oil tank 61.

The pump 62 is provided with a downwardly extending suction pipe 62*a* and an upwardly extending delivery pipe 62*b*. The suction pipe 62*a* is located at its lower end near to the bottom of the oil tank 61. In this instance, the pump 62 is capable of sucking the silicone oil to a level above the oil applying roller 48*g* and can supply the oil through an inlet into a substantially horizontal supplying pipe 63*a* (described later) at a feed rate of about 3 g to 30 g per minute.

The oil applying device 63 is provided with: an oil supplying pipe 63*a* horizontally extending above the oil applying roller 48*g* in the longitudinal direction thereof (front-to-rear direction of the digital color copier 1); a supply pipe 63*b* connecting the upstream end (X-side end) of the oil supplying pipe 63*a* with a discharge pipe 62*b* of the pump 62; a plurality of offset preventing liquid supplying ports 63*c* (only one is shown in FIG. 11) which are made in the wall of the oil supplying pipe 63*a* at a specified distance from each other within the full length of the pipe from the upstream (X) end to the downstream (Y) end in the direction of flow of silicone oil G therein; a felt member 63*d* which is pressed against a working surface of a oil applying roller 48*g* in its full length and accumulates droplets of silicone oil G from all supplying ports 63*c*; an oil applying blade 63*e* provided on downstream side relative to the felt member 63*d* in the rotation direction of the oil applying roller 48*g* to form a uniform layer of silicone oil over the surface of the roller 48*g* along the full length thereof; an oil pan 63*f* disposed under the oil applying roller 48*g* and the felt member 63*d* to receive unused droplets of excessive silicone oil G; and a return pipe 63*g* connected at one (upper) end to the bottom end of the oil pan 63*f* and connected at the other (lower) end to the return port 61*c* of the oil tank 61. In this instance, silicone oil G in the oil tank 61 is supplied by the pump 62 via the discharge pipe 62 and the supply pipe 63*b* into the oil supplying pipe 63*a* wherefrom it flows out through every supplying port 63 and falls in the form of droplets to the felt member 63*d*. The silicone oil is then applied by the felt member 63*d* onto the working surface of the oil applying roller 48*g* and further spread by the applying blade 63*e* to form a thin film of the silicone oil fed at a specified feed rate. At the same time, unused droplets of excessive silicone oil G from the oil applying roller 48*d* and the felt member 63 are collected into the oil pan 32*f* wherefrom the collected oil is returned via the return pipe 63*g* and the return port 61*c* into the oil tank 61.

Figure 12:
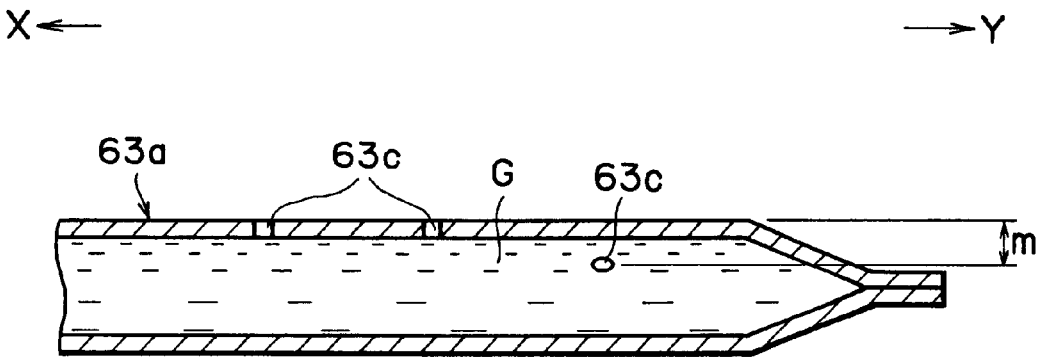
FIG. 12 is a sectional view of a downstream portion of a horizontally placed oil supplying pipe when being viewed from the right of the toner fixing device of FIG. 11.

One of the constructional feature of the present invention is such that, as shown in FIG. 12, all supplying ports 63*c* other than a supplying port 63*c* nearest to the downstream end of the supplying pipe 63*a* are open in the top wall thereof and only the port adjacent to the downstream end is open at a position lower than the upstream side supplying ports by a size m (about ⅓ the diameter of the oil supplying pipe 63*a*) in the side wall of the pipe 63*a*. In this instance, the oil supplying pipe 63*a* has a diameter of about 5 mm to 10 mm since silicone oil is supplied by the pump 62 at a flow rate of 3 g to 30 g per minute. The downstream end of the supplying pipe 63*a* is caulked by pressing so that silicone oil G can flow out only through the supplying ports 63*c* made in the wall of the supplying pipe.

Figure 13:
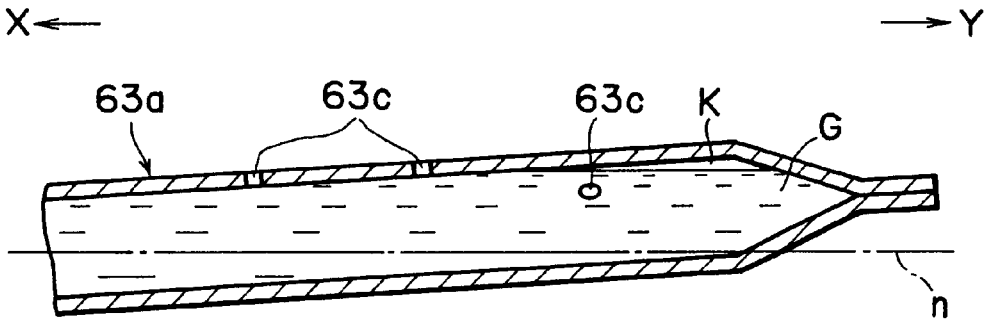
FIG. 13 is a sectional view of the downstream portion of the oil supplying pipe tilted up in the downstream direction when being viewed from the right of the fixing device of FIG. 11.

In the shown embodiment, when the copier 1 is placed in a tilted state with the oil supplying pipe 63*a* sloped up at its downstream end (Y side) relative to the horizontal line n as shown in FIG. 13, silicone oil G can smoothly flow out through the port 63*c* made in the lower level wall portion nearest to the downstream end of the oil supplying pipe 63*a*.

When the copier 1 is placed in a state tilted in the left-to-right (L–R) direction perpendicular to the longitudinal direction of the oil supplying pipe 63*a*, the oil supplying port 63*c* nearest to the downstream end of the oil supplying pipe 63*a* does not reduce its sectional area. Therefore, outflows of silicone oil G through the upstream-side ports 63*c* under a higher pressure may create an air layer K in the downstream end portion by the effect of the viscosity of the silicone oil G therein but the silicone oil may smoothly flow out through the port nearest to the downstream closed end of the supplying pipe 63*a*, avoiding the air layer K.

This makes it possible to maintain an equally balanced feeds of silicone oil along the full length of the oil supplying pipe 63*a* (in the X–Y direction), i.e., through all the oil supplying ports in the upstream and downstream portions thereof cooperating with supplying of the oil G from each of supplying ports 63*c* which is open at the upper position on upstream side (X) of the oil supplying pipe 63*a*.

The use of the above silicone oil supplying system 60 enables the copier 1 to have the increased reliability of its performance by providing reliable protection against wrapping of recording paper around the upper fixing roller 48 or contamination of a fixed image with offset toner due to partially insufficient feed of the silicone oil to the working surface of the fixing roller 48 in its longitudinal (X–Y) direction and reliable protection against leakage of silicone oil G due to partially excessive feed of the oil in the longitudinal (X–Y) direction of the upper fixing roller.

Figure 14:
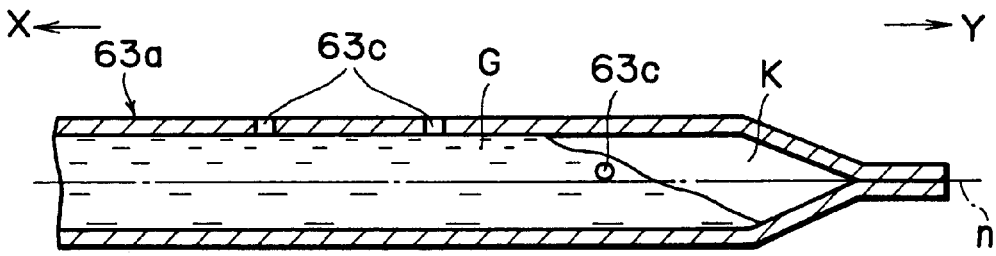
FIG. 14 is a sectional view of the downstream portion of a horizontally placed oil supplying pipe, viewed from the right side thereof, according to another embodiment of the present invention.

In the above embodiment, the oil supplying port 63*c* nearest to the downstream end of the oil supplying pipe 63*a* is open at a level lower than by the size n (about ⅓ the diameter of the oil supplying pipe 63*a*) each of the remaining upstream side ports. However, it is also possible to locate the oil supplying port 63*c* nearest to the downstream end of the oil supplying pipe 63*a* at a level lower than by a size p (about ½ the diameter of the pipe 63*a*) each of the upstream side ports 63*c* as shown in FIG. 14. In this instance, it seems that a level of silicone oil G in the downstream end portion of the oil supplying pipe may be low as shown in FIG. 14 and a large part of the silicone oil may flow out through the lowest port 63*c* adjacent to the downstream end. In practice, silicone oil G can sufficiently flow out through the upstream side ports 63*c* owing to the combined effect of the viscosity of the oil G, the flow rate per minute of the pump 62 and the diameter of the oil supplying pipe 63*a*.

Figure 15:
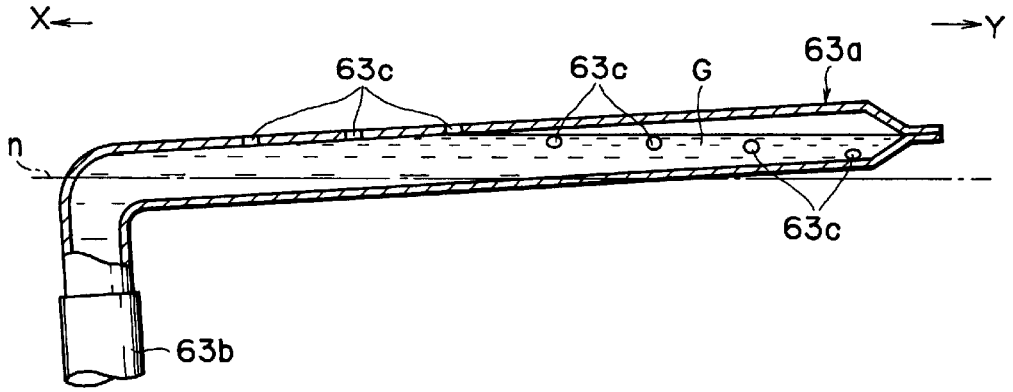
FIG. 15 is a sectional view of the downstream portion of the oil supplying pipe according to another embodiment in the state tilted up in the downstream direction when viewed from the right side thereof.
Figure 16:
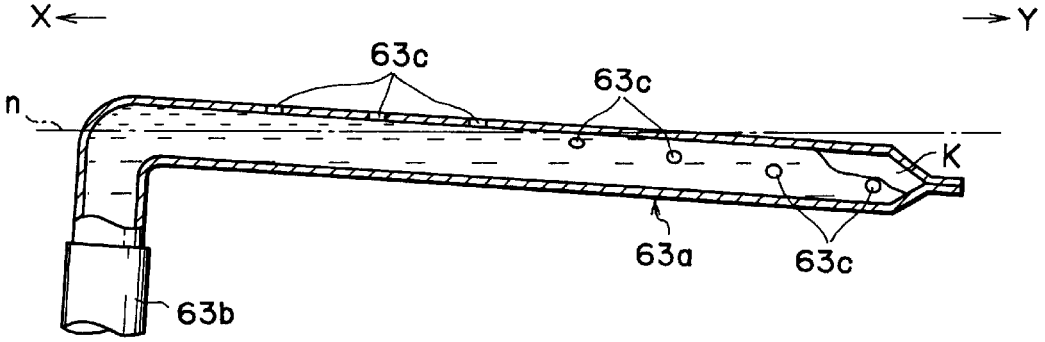
FIG. 16 is a sectional view of the downstream portion of the oil supplying pipe of FIG. 15 in the state tilted up in the upstream direction when viewed from the right side thereof.
Figure 17:
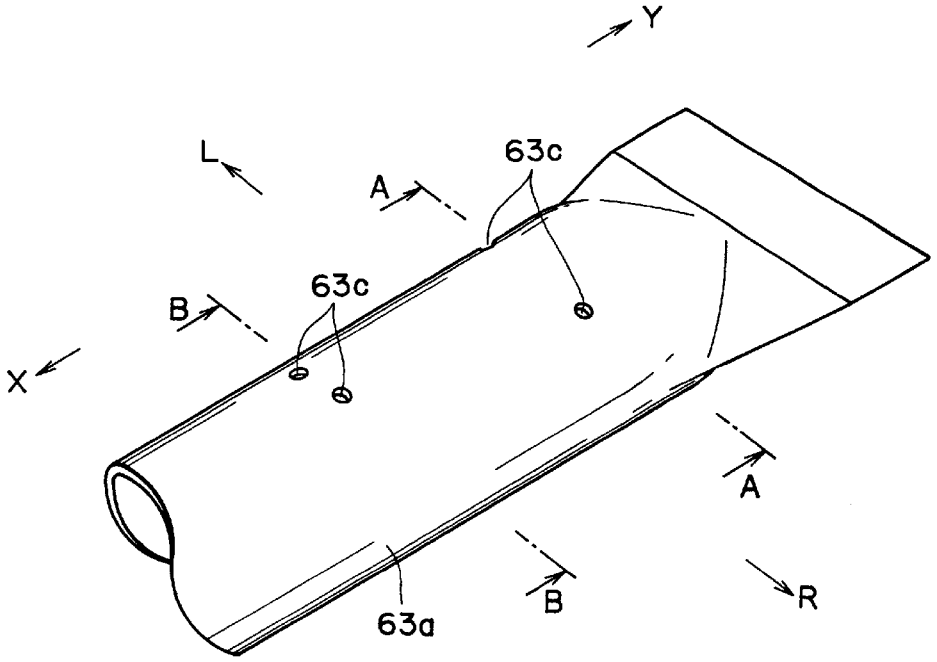
FIG. 17 is a perspective view of the downstream portion of the oil supplying pipe of another embodiment.

Although the shown embodiment adopts the oil supplying pipe 63*a* having upwardly opening oil supplying ports 63*c* made therein excepting only the port nearest to the downstream end and the port nearest to the downstream being open in the lower position of the wall thereof, it is also possible to arrange plural oil supplying ports in the downstream side of the oil supplying pipe in such a way that they are open at different levels gradually (step-by-step) descending in the direction from the upstream side (X) to the downstream side (Y) as shown in FIGS. 15 and 16. In this instance, the silicon oil G can smoothly flow out through oil supplying ports 63*c* being open at levels gradually descending in the direction from the upstream side to the downstream side irrespective of the tilted state of the copier 1 (in the direction causing the oil supplying pipe 63*a* to be tilted at its downstream end up or tilted to left (L) or right (R)), thus realizing the equally balanced feeds from all the oil supplying ports 63*c* on the both upstream side and downstream side of the oil supplying pipe 63*a* in the longitudinal (X–Y) direction thereof. Furthermore, the above oil supplying pipe with ports made in the wall thereof with the same diameter but at different levels can realize the uniform feed of silicone oil and can be manufactured at a low cost as compared with an expensive pipe with oil supplying ports made in its wall by laser machining to have different diameters (openings) increasing in the direction from the upstream side to the downstream side to maintain a uniform supplying of silicone oil. In addition, when the digital color copier is used in a tilted state with the downstream side (Y) of the oil supplying pipe 63*a* above the horizontal line n as shown in FIG. 15, silicone oil can smoothly flows out from the oil supplying pipe through the downstream side ports 63*c* being lower than the oil surface as shown in FIG. 15. Contrary to the above, when the copier is placed in a tilted state with the downstream side (Y) of the oil supplying pipe 63*a* below the horizontal line n, silicone oil can smoothly flow out through the upstream side ports 63*c* of the pipe 63*a* since the ports may become below the surface of oil supplied under a high pressure into the upstream portion of the pipe.

Furthermore, it is of course possible to make all oil supplying ports (not limited to a single or plural ports in the downstream portion) in the wall of the oil supplying pipe at different opening levels descending in the direction from the upstream (X) side to the downstream (Y) side thereof.

Figure 18:
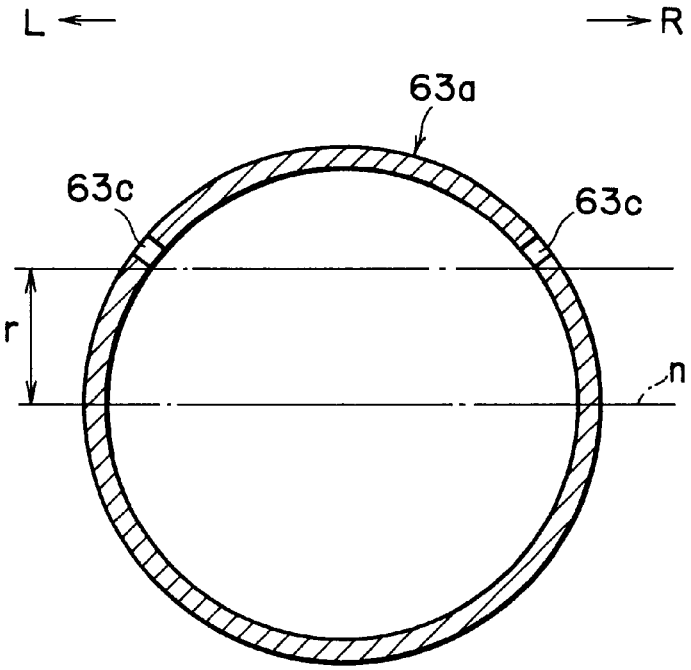
FIG. 18 is a sectional view taken along the plane A—A of FIG. 17.
Figure 19:
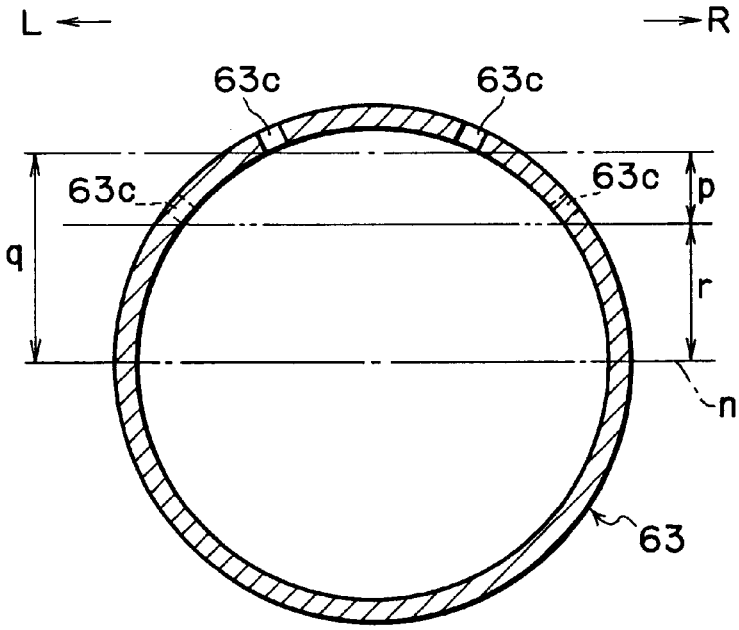
FIG. 19 is a sectional view taken along the plane B—B of FIG. 17.

Although the shown embodiment uses the oil supplying pipe 63*a* provided in its wall with a single row of oil supplying ports 63*c* arranged at a specified distance from each other in the upstream and downstream portions, it may also use an oil supplying pipe provided in its wall with pairs of oil supplying ports 63*c*, each pair composed of two ports positioned symmetrically in a sectional plane perpendicular to the longitudinal axis of the oil supplying pipe 63*a* (in the direction of right and left). Only the paired ports 63*c* nearest to the downstream end of the oil supplying pipe 63*a* are open at the level lower than other paired ports 63*c* by the size p (a result of subtracting a size (r) shown in FIG. 19 from a size (q) shown in FIG. 18). Alternatively, it is of course allowed to use an oil supplying pipe with a plurality of paired ports or all paired ports shifted down (to lower opening levels) in the direction from the upstream (X) side to the downstream (Y) side. In this instance, silicone oil can smoothly flow out through all pairs of symmetrically positioned ports 63*c* in both upstream and downstream portions of the oil supplying pipe 63*a*. In particular, when the digital color copier 1 is placed in a state tilting in the transverse (L–R) direction with the above oil supplying pipe, ones of all paired ports 63*c* are positioned lower than the others and allows silicone oil to surely flow out. This is of a great advantage to achieve the equally balanced supplying of silicone oil G through the ports 63*c* arranged in the longitudinal direction of the oil supplying pipe 63*a*.

The advantages of the present invention are as follows:

The use of the offset preventing liquid supplying pipe with ports being open in the upper position of the upstream portion thereof and ports being open in the lower positions of the downstream portion thereof realizes smooth supplying of offset preventing liquid through the supplying ports being open in the lower positions of the downstream portion of the oil supplying pipe irrespective of the tilted state of the image forming device, thus maintaining equally balanced supplying of the offset preventing liquid to a full length of a heat roller.

The use of the offset preventing liquid supplying pipe with supplying ports at different levels descending in steps in the direction from the upstream side to the downstream side realizes smooth supplying of the offset preventing liquid through the downstream ports irrespective of the tilted state of the image forming device, thus maintaining more uniformly balanced supplying of the offset preventing liquid to the full length of the heat roller.

The offset preventing liquid supplying ports are also provided in pairs in the wall of the supplying pipe in such a way that two ports of each pair are located at opposite positions in a section perpendicular to the direction of the liquid flow in the supplying pipe. This not only realizes smooth supplying of the offset preventing liquid through the supplying ports in both upstream and downstream portions but also provides a great advantage to achieve evenly balanced supplying of the offset preventing liquid to a working surface of the heat roller over the full length thereof by supplying through a lower level port of each pair when the supplying pipe has a slope in the direction perpendicular to the longitudinal direction of the heat roller.

Specifically, an image forming device provided with the above described offset preventing liquid supplying device of a toner image fixing device can reliably preventing a paper sheet from wrapping around a heat roller due to partially insufficient feed of offset preventing liquid relative to the length of the heat roller and can surely prevent contamination with offset toner of an image to be fixed on a next paper sheet. It is also capable of reliably preventing leakage of offset preventing liquid fed in excess to a part of the heat roller.

All the above merits enable the image forming device to achieve an increased reliability of its performance.

What is claimed is:

1. An offset preventing liquid supplying device for supplying offset preventing liquid to a heat roller of a toner image fixing device for fixing a toner image developed on a recording material by heating with the heat roller, comprising:

a storage means for storing offset preventing liquid, a liquid applying means for applying offset preventing liquid onto a cylindrical surface of the heat roller, and a pump for supplying the offset preventing liquid to the liquid applying means, wherein said liquid applying means has a series of offset preventing liquid supplying ports provided from an upstream side to a downstream side thereof in an offset preventing liquid supplying direction, an upstream side liquid supplying port is open at an upper position and downstream side liquid supplying port is open at a lower position, and the offset preventing liquid supplying ports are formed in pairs, each being composed of two ports opposite to each other at symmetrical right and left positions in a sectional direction perpendicular to the offset preventing liquid supplying direction.

2. An offset preventing liquid supplying device for a toner image fixing device as defined in claim 1, wherein the offset preventing liquid supplying ports are open at different levels in descending order in an offset preventing liquid supplying direction from the upstream side to the downstream side.

3. An image forming device provided with an offset preventing liquid supplying device of a toner image fixing device according to claim 2.

4. An image forming device provided with an offset preventing liquid supplying device of a toner image fixing device according to claim 1.

* * * * *